United States Patent [19]

Barnett

[11] Patent Number: 4,565,182

[45] Date of Patent: Jan. 21, 1986

[54] CROSSBOW WITH ROTATABLE MAGAZINE HAVING OPEN-SIDED CHANNELS

[75] Inventor: Bernard T. Barnett, Ryton, Nr. Shifnal, England

[73] Assignee: B & P Barnett Limited, West Midlands, England

[21] Appl. No.: 522,584

[22] Filed: Aug. 12, 1983

[30] Foreign Application Priority Data

Dec. 21, 1982 [GB] United Kingdom ..... 8236256

[51] Int. Cl.[4] ..... F41B 5/00

[52] U.S. Cl. ..... 124/25; 124/41 R; 124/48

[58] Field of Search ..... 124/48, 25, 41 R, 83, 124/23 A, 24 A, 86, 88

[56] References Cited

U.S. PATENT DOCUMENTS

| | | | |
|---|---|---|---|
| 1,985,079 | 12/1934 | Conklin | 124/25 |
| 2,516,341 | 7/1950 | Raffeis | 124/25 X |
| 2,918,050 | 12/1959 | Kopman | 124/25 |
| 3,017,874 | 1/1962 | Gubash | 124/48 X |
| 3,116,730 | 1/1964 | Tingley | 124/48 X |
| 3,601,113 | 8/1971 | Wilkie | 124/48 |
| 3,693,609 | 9/1972 | Vodinh | 124/41 R X |

FOREIGN PATENT DOCUMENTS

| | | | |
|---|---|---|---|
| 2514165 | 2/1976 | Fed. Rep. of Germany | 128/48 |

*Primary Examiner*—Richard T. Stouffer

*Attorney, Agent, or Firm*—Berman, Aisenberg & Platt

[57] ABSTRACT

A crossbow is provided with a magazine which holds several bolts. A plurality of open-sided channels defined by the magazine receive the bolts. The magazine is mounted on a stock of the crossbow for rotation to move successive bolts into a firing position.

1 Claim, 3 Drawing Figures

CROSSBOW WITH ROTATABLE MAGAZINE HAVING OPEN-SIDED CHANNELS

BACKGROUND OF THE INVENTION

This invention relates to a crossbow.

Crossbows commonly comprise a stock which defines a path for a bolt and a resiliently flexible cross-piece known as a prod at one end portion of the stock. A string is attached at its ends to respective ends of the prod and a catch on the stock holds the string when the crossbow is in a cocked condition, the string having been drawn back from the prod preparatory to firing a bolt from the crossbow. A trigger may be operated to releases the string from the catch so that the string propels the bolt along the path.

In known crossbows, a bolt is placed in a firing position on the stock by hand. Each time a bolt is fired from the crossbow, the user takes a fresh bolt from a supply and places it in the firing position either before or after drawing the string back to the cocked position.

SUMMARY OF THE INVENTION

According to the invention, there is provided a crossbow stock containing a rotary magazine for holding a plurality of bolts, the magazine being movable relative to the stock about an axis, for presenting the bolts in succession to a firing position on the stock, wherein the magazine comprises arms which extend away from the axis and along the length of the magazine, wherein the magazine defines a plurality of open-sided channels for receiving respective bolts, which channels are spaced apart about the axis of rotation and, each of which channels is defined between a respective pair of said arms, and wherein the magazine comprises holding means operative while in a holding position for releasably holding a bolt in a respective one of said channels, said holding means being movable relative to said channels out of the holding position, and the holding means being urged resiliently out of the holding position.

BRIEF DESCRIPTION OF THE DRAWINGS

An example of a crossbow having a stock and magazine in accordance with the invention will now be described with reference to the accompanying drawing wherein.

DETAILED DESCRIPTION

Figure 1:
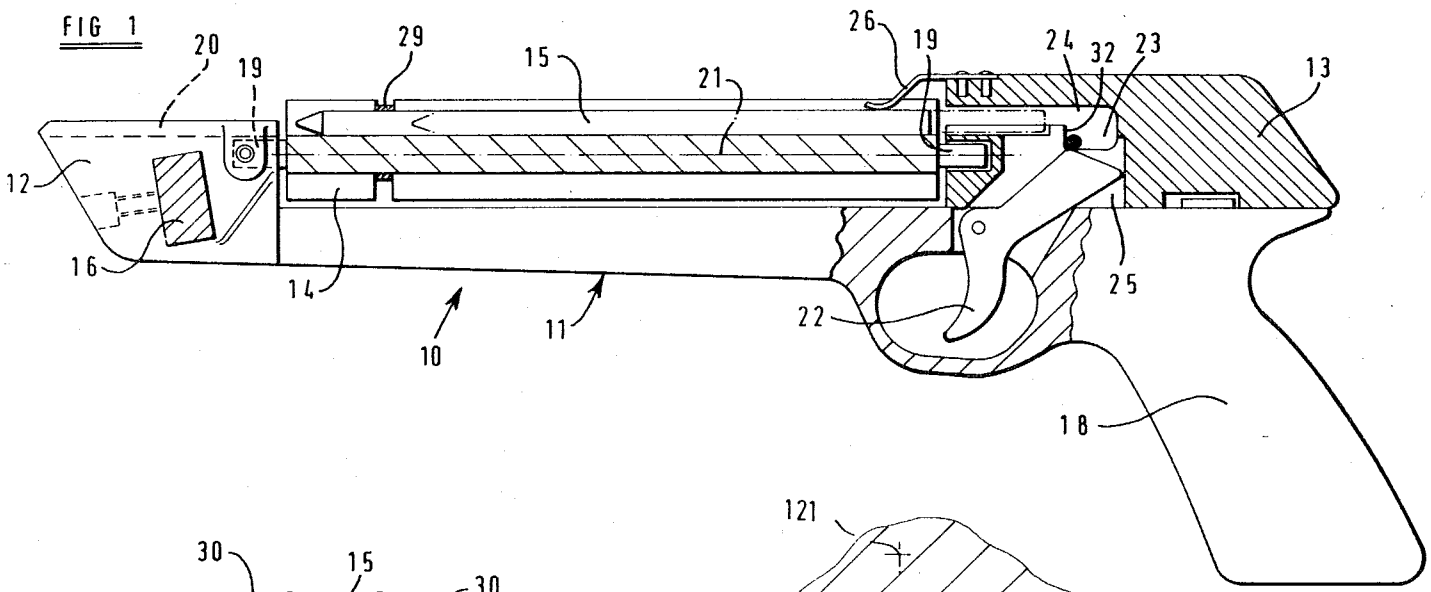
FIG. 1 shows a cross-section of the crossbow with a bolt loaded on the magazine.

The crossbow 10 comprises a stock 11 with a prod 16 mounted on and extending through a fore-end portion 12 of the stock. A string is attached at either end to respective ends of the prod. A rear housing 13 mounted at the rear end portion of the stock comprises a catch which forms surface 32 of a recess 23 for receiving a mid-portion of the string when the string has been drawn back from the prod preparatory to firing of the crossbow. The crossbow further comprises a trigger 22 which can be pivoted to release the string from the recess. The rear end portion of the stock extends into a handle 18 adajcent to the trigger so that the crossbow can be held and fired in one hand in the same manner as a pistol.

The crossbow 10 further comprises a magazine 14 which is, typically, formed of metal and can hold upto three bolts 15. When mounted on the stock 11, the magazine extends between the fore end portion 12 and the rear housing 13. When the magazine is mounted on the stock, the magazine is movable relative to the stock to present successive bolts to a firing position on the crossbow. The magazine comprises co-axial pins 19 at either end thereof which define an axis 21. The pins extend into respective cylindrical apertures in, respectively, the fore end portion and rear housing so that the magazine is rotatable about the axis 21. The axis extends in a direction parallel to the length of the stock 11.

Figure 2:
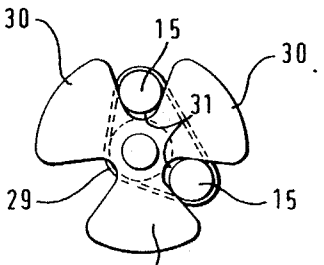
FIG. 2 is an end view of the magazine dismounted from the crossbow.

The magazine 14 comprises three arms which extend away from the axis 21 and along the length of the magazine. The arms are equally spaced about the axis to define three channels 31 for receiving respective bolts 15. The magazine is elongate and is slightly longer than the bolts. It will be appreciated that different examples of magazine may comprise different numbers of amrs and thereby be adapted to receive different numbers of bolts. FIG. 1 shows one bolt held on the magazine in a first position wherein the bolt is presented to a firing position, as is hereinafter described. For releasably holding a bolt in the magazine there is provided means comprising a flexible elastic band 29. The band can hold respective bolts in all of the channels of the magazine and extends around the magazine adjacent to the front end thereof. The band 29 extends through respective transverse slots 28 in each of the arms. In the magazine shown in FIG. 2, two bolts are held by the band in respective channels. In the third channel which does not contain a bolt, a portion of the band therein has been elastically drawn in to an inner position closer to the axis of the magazine than respective portions of the band in the other channels. Drawing in of the band in a channel without a bolt is limited by engagement of the band with outwardly facing surfaces of the slots 28 in arms on either side of the channel. The band is sufficiently elastic to hold securely one, two or three bolts on the magazine. A nose of a bolt can be inserted into the gap between the portion of the band in the inner position and the magazine facilitate loading.

The fore-end portion 12 of the crossbow defines a groove 20 along the upper surface thereof and the rear housing 13 defines a bolt aperture 24, which extends from the forward surface thereof and is aligned with the groove. With the magazine in the orientation shown in FIG. 1, a channel 31 of the magazine is aligned with the groove and bolt aperture and the bolt is in the first position. The groove, channel and bolt aperture together define a path for a bolt with which the bolt is aligned. Means may be provided for locating the magazine in any selected one of those positions about the axis 21 in which a channel of the magazine is aligned with the groove 20 and the aperture 24.

The bolt aperture 24 receives a rear portion of a bolt when the bolt is drawn back from the first position on the magazine to a firing position. In FIG. 1, a bolt is shown in the firing position by means of a broken line. The rear end of the bolt is adjacent to the recess 23 which is a part of the bolt aperture. When the bolt is drawn back, the band rides over the bolt until the bolt clears the band. The band is then drawn to the inner position relative to the axis of the magazine, in which position the band does not impeded passage of a bolt along the path. A leaf-spring 26 mounted on the upper surface of the rear housing protrudes forwardly from the housing and downwardly to engage the bolt. The leaf spring is sufficiently biased to hold the bolt in the firing position but not to impede significantly firing of the bolt along the path by the prod and bow string.

The rear housing 13 further comprises a trigger aperture 25 which extends from the bolt aperture to a lower side of the housing and in which the trigger 22 can be pivoted about a pivotal engagement of the trigger with the stock 11. When in the position shown in FIG. 1, an upper portion of the trigger is adjacent to but not in the recess 23. The recess comprises a surface 32 which faces in a direction away from the fore-end portion of the crossbow. When a mid-portion of the string of the crossbow is drawn through the bolt aperture into engagement with the surface, the crossbow is cocked, that is to say the string is taut and is prevented from drawing towards the fore-end portion. When the trigger is pivoted by pulling on a lower portion thereof which protrudes from the stock, the upper portion moves into the recess to dislodge the string from engagement with the surface. The string then engages the rear end of a bolt in the firing position and propels the bolt along the path as the string is drawn towards the fore-end portion. It will be noted that, when the bolt is in the firing position, the string engages the rear end thereof while in or immediately after being dislodged from the recess. It has been found that, where the string moves some distance before engaging the bolt, the string may snap under or over the bolt.

The rear housing 13 is slidably mounted on the stock 11 of the crossbow. When the crossbow is to be used, the magazine is loaded with bolts, preferably prior to mounting of the magazine on the crossbow, the magazine then being mounted by sliding the rear housing in a direction away from the front end portion and inserting the pins 19 of the magazine into respective apertures before sliding the rear housing back into position. In an alternative example, the pins are spring biased and may be retracted into the magazine to enable the magazine to be mounted. The magazne may alternatively be loaded with bolts while mounted on the stock.

The magazine is rotated about its axis so that a bolt is held in the aligned position wherein it is presented to the firing position. The bolt is then drawn back by hand so that it occupies the firing position. In an alternative embodiment of crossbow, not shown in the drawing, a separate drawing back of the bolt is not required prior to the firing of the crossbow. The crossbow is then cocked by drawing back the string into the recess in the rear housing and the crossbow is fired by pulling the trigger. The string propels the bolt along the path, riding over the magazine as said string is drawn towards the fore-end portion. In the example of crossbow illustrated, the magazine is thereafter turned manually to present the next bolt to the firing position. In an alternative example, the magazine is automatically rotated through the desired angle upon re-cocking of the crossbow.

Figure 3:
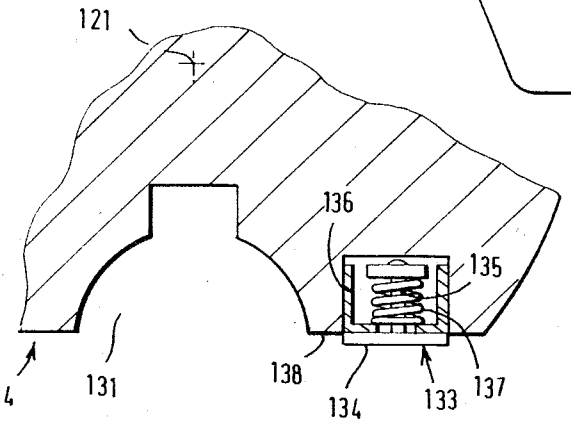
FIG. 3 shows on an enlarged scale a fragmentary transverse cross-section through a part of an alternative magazine.

The alternative magazine 114 illustrated in FIG. 3 may be used in place of the magazine 14 hereinbefore described. The magazine 114 has three recesses to receive respective bolts, these being spaced apart equally about a longitudinal axis 121 of the magazine. There is provided on the magazine adjacent to each of the recesses 131 a respective retaining element 133.

Each retaining element 133 comprises a head 134 and a shank 135 which is integral with or is fixed to the head. The shank extends into a bush 136 mounted in an opening in the magazine. Within the bush, there is disposed a resilient element 137 which urges the head 134 towards the plane of an adjacent surface 138 of the magazine. In the example illustrated, the resilient element is in the form of a compression spring trapped between an internal flange on the bush 136 at its outer end and a washer mounted on the inner end of the shank 135 and secured thereto by riveting over of the free end of the shank.

When a bolt is loaded into the recess 131 adjacent to one of the retaining elements 133, the head 134 of the retaining element is drawn away from the surface 138 and a fin on the bolt is moved over the surface 138 into a position in which it partly underlies the head 134. The head is then released to engage the fin and to hold the fin firmly in contact with the surface 138. Friction between, on the one hand, the bolt and, on the other hand, the surface 138 and the underside of the head 134 does not significantly impede firing of the bolt from the cross-bow.

I claim:

1. In a crossbow comprising an elongated stock with a fore-end portion and a rear-end portion and a prod mounted on and extending outwardly from the fore-end portion of the stock, a magazine for holding a plurality of bolts mounted on the stock between the rear-end portion and the fore-end portion, wherein the improvement comprises said magazine being movable relative to the stock abut an axis of rotation parallel to the longitudinal extent of the stock for presenting the bolts in succession to a firing position on the stock, wherein the magazine comprises arms which extend away from the axis and along the length of the magazine, wherein the magazine defines a plurality of open-sided channels for receiving respective bolts, which channels are spaced apart about the axis of rotation and each of which channels is defined between a respective pair of said arms, and wherein the magazine comprises holding means operative while in a holding position for releasably holding a bolt in a respective one of said channels.

* * * * *